US005597025A

United States Patent [19]

Forkner

[11] Patent Number: 5,597,025

[45] Date of Patent: Jan. 28, 1997

[54] SECTIONED WINDOW CORNICE

[76] Inventor: Sharon A. Forkner, 903 E. Seventh, Lamar, Mo. 64759

[21] Appl. No.: 388,552

[22] Filed: Feb. 14, 1995

[51] Int. Cl.[6] ..... E06B 9/00

[52] U.S. Cl. ..... 160/38; 160/39; 160/368.1

[58] Field of Search ..... 160/38, 39, 368.1, 160/330

[56] References Cited

U.S. PATENT DOCUMENTS

| | | | |
|---|---|---|---|
| D. 84,537 | 6/1931 | Oberting . | |
| D. 169,585 | 5/1953 | Goodstein . | |
| 1,652,365 | 12/1927 | Kretschmer | 160/38 |
| 2,243,222 | 5/1941 | Rebholz . | |
| 2,501,133 | 3/1950 | Levy . | |
| 2,549,448 | 4/1951 | Gantner | 160/38 X |
| 3,996,987 | 12/1976 | Rodriguez . | |
| 4,828,002 | 5/1989 | Ashby | 160/38 |
| 5,042,548 | 8/1991 | Attal | 160/38 |
| 5,042,549 | 8/1991 | Roberts . | |
| 5,383,508 | 1/1995 | Pavlica et al. | 160/38 |

FOREIGN PATENT DOCUMENTS

| | | | |
|---|---|---|---|
| 172100 | 4/1960 | Australia | 160/38 |
| 1529593 | 6/1968 | France . | |
| 532342 | 8/1931 | Germany | 160/38 |
| 165104 | 1/1934 | Switzerland . | |

*Primary Examiner*—Blair Johnson
*Attorney, Agent, or Firm*—Richard C. Litman

[57] ABSTRACT

A sectioned window cornice may be adapted to various widths of windows and drapery support rods thereon. The cornice may be easily assembled from several identical, repeating panels with symmetrical attachment ends to provide for universal assembly of the panels to form a cornice of the desired length. The cornice may include a decorative bas relief or other pattern thereon, which pattern preferably repeats with each panel and is adapted to match exactly with the pattern of an adjoining panel, to avoid any unsightly perceived mismatch of shapes and patterns on the assembled cornice. The assembled modular sections are secured to the front surface of a drapery support rod or the like by hook and loop fastening material, thereby providing for assembly and installation without need of any tools and enabling the cornice to be assembled and installed by unskilled labor in a minimum amount of time and effort, and enabling an installed cornice to be removed and replaced easily, as desired. The assembled cornice may also be easily and quickly removed and disassembled, as desired. Plastics, wood, and/or fiberboard or the like may be used to form the present cornice sections.

20 Claims, 1 Drawing Sheet

SECTIONED WINDOW CORNICE

FIELD OF THE INVENTION

The present invention relates generally to trim panels and the like for windows and similar features in building structures and the like, and more specifically to a cornice which is provided in mating sections for installation with different widths of windows. The cornice sections secure together end-to-end, and also secure to an existing drapery rod or the like.

BACKGROUND OF THE INVENTION

The provision of greater beauty and ambience in the home is virtually a universal desire with homeowners, and numerous articles have been developed in the past for the purpose of concealing various structural components or providing a more decorative appearance to a given area of the home. Window cornices and lambrequins are an example of such devices, which are intended to conceal or decorate the area above a window or the like, and/or the curtain or drapery rod at the top of the window.

However, windows are not a standard size, and it can be difficult to locate a cornice of the proper size or length for a given window, particularly when one is looking for a particular style or design. Oftentimes, the correct size cornice is not available at all, or at least not with a design desired by the purchaser. If a cornice of a different size, but having a desired pattern or design, is chosen, it generally must be custom modified in order to fit the installed location properly, which specialized work is relatively costly and may be more than the original purchase cost of the cornice itself.

Accordingly, a sectioned cornice comprising a plurality of mating portions or sections and which may be easily assembled and installed by a person with minimal skills and time, will be seen to be desirable. The cornice components are preferably provided with attractive ornamentation and/or decoration of various patterns thereon, with the patterns repeating and matching unobtrusively at each cornice section joint. The components may be formed of plastic, wood, fiber or chip board, and/or other economical materials as desired, and quick, simple, and economical installation means must also be provided.

DESCRIPTION OF THE PRIOR ART

U.S. Pat. No. 2,243,222 issued to Elmer F. Rebholz on May 27, 1941 discloses a Cornice having a sheet metal fascia over a board. The fascia includes a plurality of spaced apart score or bend lines, along which the fascia may be bent or folded to adapt to the length of the cornice board. However, the board itself must still be custom cut to the required length, and the fascia panel applied over the board. The present invention does not have a separate structural board member and decorative fascia applied thereover, but comprises a plurality of unitary sections which may be secured together end-to-end as required.

U.S. Pat. No. 2,501,133 issued to William G. Levy on Mar. 21, 1950 discloses a Cornice comprising a plurality of sections which may be assembled together to form the desired length. Each section, however, is non-symmetrical, and may only be assembled with the appropriate mating edge of an adjoining panel. Tongue and groove and pins in mating holes are used, and the attachment means is also different from that of the present invention.

U.S. Pat. No. 3,996,987 issued to Edith Rodriguez on Dec. 14, 1976 discloses a Convertible Valence wherein a light fabric cover (actually a lambrequin) may be replaceably installed on an existing valence panel. The panel is fixed, and no disclosure is made of modular panel sections for the solid valence panel itself. The only relevance to the present invention is the use of hook and loop fastening material (i. e., Velcro—tm) to secure the fabric to the existing valence, rather than to secure the modular cornice to the drapery rod, as in the present invention.

U.S. Pat. No. 5,042,549 issued to Beverly R. Roberts on Aug. 27, 1991 discloses a Window Treatment Crown comprising a plurality of cornice boards of foam plastic material, which boards are custom cut to the desired size and cemented together. The components are not modular, nor can they be disassembled after assembly, as in the present window cornice.

U.S. Pat. No. D-84,537 issued to Marie R. Oberting on Jun. 30, 1931 discloses a Lambrequin apparently comprising flat stock which has been cut or stamped to provide a floral outline or pattern therein. No interconnecting means or installation means is disclosed, as the disclosure is a design patent.

U.S. Pat. No. D-169,585 issued to Wallace M. Goodstein on May 19, 1953 discloses a Sports Display Cornice Unit comprising a flat panel with various flat representations of sports equipment thereon. No panel interconnecting means is disclosed, and the hooks apparently used to secure the panel to a drapery rod are unlike the hook and loop fastening of the present invention, wherein the cornice panels are preferably secured only to the front of the rod to preclude interference with drapery cords.

Swiss Patent No. 165,104 to Schmidt Riloga Werk and published on Jan. 16, 1934 discloses a valence panel including various means providing for the attachment of the panel to an underlying structure. No plural, modular, interconnecting panels are disclosed, as provided by the present invention.

Finally, French Patent No. 1,529,593 to Marcel Assael and published on Jun. 21, 1968 discloses an adjustable valence for a window. The valence may be adjusted outwardly or inwardly, or up or down vertically, relative to the window, but may only be adjusted for window width by a single central panel which is secured to the opposite end panels by screws therethrough. No end-to-end fastening of panels together with fasteners which do not require tools is disclosed, as provided by the present invention.

None of the above noted patents, taken either singly or in combination, are seen to disclose the specific arrangement of concepts disclosed by the present invention.

SUMMARY OF THE INVENTION

By the present invention, an improved sectioned window cornice is disclosed.

Accordingly, one of the objects of the present invention is to provide an improved window cornice which is modular, and which modular sections may be adapted to any practicable window width.

Another of the objects of the present invention is to provide an improved window cornice which modular sections are symmetrical and which may be assembled without need for tools of any sort.

Yet another of the objects of the present invention is to provide an improved window cornice which fastening means comprises symmetrical tabs which interlock with each adjacent panel.

Still another of the objects of the present invention is to provide an improved window cornice which structural and decorative means are integrated in each single, unitary cornice section.

A further object of the present invention is to provide an improved window cornice which components are removably securable to the front of a supporting drapery rod or the like with hook and loop fastener means, and which components may be quickly and easily assembled and disassembled as desired.

An additional object of the present invention is to provide an improved window cornice which may be constructed of plastic, wood, fiberboard or other inexpensive materials, as desired.

Another object of the present invention is to provide an improved window cornice which modular components lend themselves to the inclusion of a repeating bas relief decorative pattern thereon, and which pattern is formed to match at each edge of each adjacent panel or section.

A final object of the present invention is to provide an improved sectioned window cornice for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENT

Figures 1, 2:
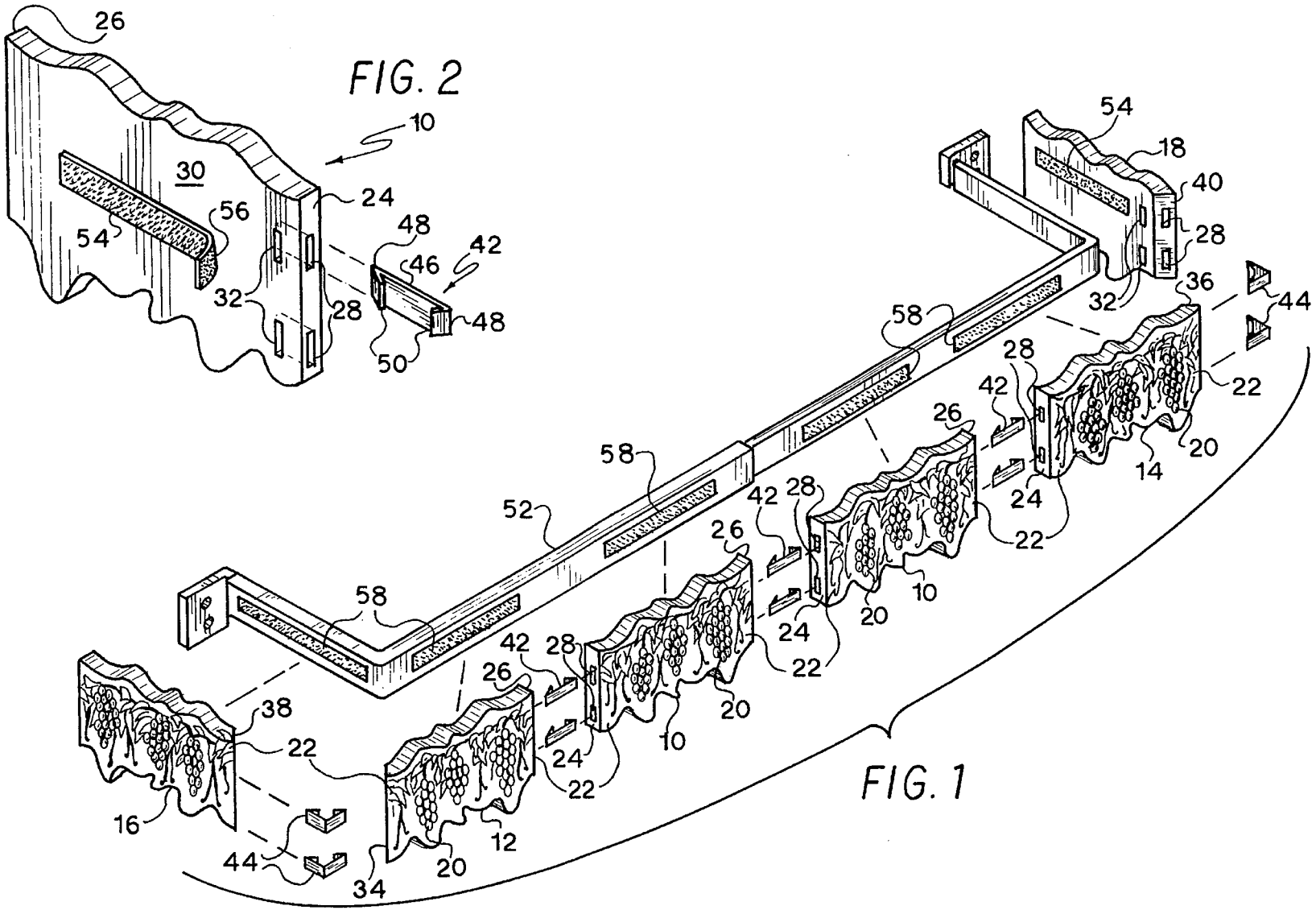
FIG. 1 is an exploded perspective view of the present invention, showing its various features and assembly and attachment means.
FIG. 2 is a perspective view of a single modular section or panel, showing a detail of the panel interconnecting clip means.

Referring now particularly to FIG. 1 of the drawings, the present invention will be seen to relate to a sectioned window cornice providing for the assembly of plural sections thereof to an existing support (e. g., drapery rod or the like) for windows of various sizes. The cornice comprises a plurality of individual identical central front sections 10, a left and a right front end section 12 and 14, and a left and a right cornice side section 16 and 18. Each of the sections 10 through 18 will be seen to have a symmetrical shape, with each end of each section 10 through 18 being of equal height in order to match precisely with an adjoining section.

Preferably the patterns provided thereon (e. g., the grape pattern 20 of FIG. 1) are smoothly blended at each end of each section 10 through 18, in order to provide an unobtrusive appearance devoid of any sharp discontinuities between adjoining sections. For example, it will be noted that the leaf pattern 22 at each end of each of the sections 10 through 18 is identical, to provide a proper match for adjoining sections. Other patterns (e.g., floral, geometric designs, etc.) may be used as desired.

Each of the central front panels 10 includes opposite first and second ends 24 and 26, which ends each have at least one, and preferably two, passages 28 therein, better shown in FIG. 2. Each of these passages 28 extends into each of the central front panels parallel to the smooth panel back 30, and terminates in an opening 32 at right angles to the passage 28 and extending through the back 30. In a like manner, the beveled ends 34 and 36 of the eft and right front sections 12 and 14, and the beveled ends 38 and 40 of the respectively mating left and right end sections 16 and 18, also include passages 28 which communicate with rear openings 32 in the backs of each of the sections. (The flat first end 24 of the right front section 14 and second end 26 of the left front section 12 will be seen to be identical to the first and second ends 24 and 26 of the central front sections 10, and hence are correspondingly numbered.)

The cornice is assembled by connecting or securing each flat first end 24 of each front section 10, 12, and 14, to an adjoining flat second end 26 of an adjacent section 10/12/14, using a straight clip or connector 42, so that the sections 10/12/14 are abutingly joined together, In a similar manner, the beveled ends 34 and 38 of the left front and end sections 12 and 16, and the beveled ends 36 and 40 of the right front and end sections 14 and 18, are connected together using a plurality of right angled clips 44. The operation of the two types of clips 42 and 44 is essentially the same, the only difference being the essentially straight shape of the main body of the clips 42 and the right angle bend in the center of the angled clips 44, providing for the securing of the end sections 16 and 18 at right angles to their respective adjoining side sections 12 and 14.

A detailed view of one of the straight clips 42 is shown in FIG. 2. The clip 42 is symmetrical, with a straight central portion 46 with opposite ends 48. Each of the ends 48 terminates in a flat barb or protrusion 50 adapted to engage an opening 32 of a passage 28 in the flat first and second ends 24 and 26 of the front sections 10, 12, and 14, to removably secure each of the front sections together. In a similar manner, the right angled clips 44 also include identical protrusions at each end thereof, which engage the passages and openings 28 and 32 of the beveled ends 34 through 38 of the side and end sections 12 through 20 to secure those sections together.

The clips 42 and 44 are preferably formed of a flexible, resilient material (e. g., a plastic of some sort, although spring metal may be used), with the protrusions 50 being resiliently compressed within the passages 28 as the various cornice sections are pressed together. The protrusions 50 then resiliently expand and lock within the right angled openings 32 in the backs of each of the sections, to preclude the sections from being pulled apart. When it is desired to disassemble the various sections, a small tool of some sort (knife blade, screwdriver, etc.) may be pressed into the openings 32 in the backs of the sections, to compress the protrusions 50 back into the passages 28, thereby allowing the adjoined sections to be pulled apart. It will be seen that the above described assembly and disassembly of the various sections may be completed any number of times desired, as none of the components are broken or damaged during the assembly or disassembly.

The various cornice sections described above may be removably assembled to an existing drapery rod or the like, or to a special purpose cornice support, as desired; such a rod or support is designated as 52 in FIG. 1 of the drawings.

Each of the sections 10 through 18 includes a first portion 54 of hook and loop fastening material (e. g., Velcro—tm) on the rear surface thereof, as shown in detail on the rear surface 30 of the cornice section 10 of FIG. 2. The hook and loop fastening material portion 54 may be secured to the rear surfaces of the sections by means of an adhesive backing 56 thereon. Second mating hook and loop fastening components 58 are secured to the rod or support 52. Thus, the various cornice sections 10 through 18 may be secured to the rod or support 52, and removed as desired for cleaning, reinstallation at another area, etc.

Preferably, the present cornice sections 10 through 18 are formed of a lightweight material which may be molded easily to form decorative bas-relief patterns or the like thereon; plastic is the preferred medium for such cornice sections. However, the sections may be formed of other materials, such as wood, or provided with a simulated wood grain pattern or finish if desired. Less expensive materials may be used for greater economy if desired, such as wood fiber or fiberboard materials. While the pattern shown in FIG. 1 of the drawings is of a grape and grape vine appearance, it will be understood that virtually any pattern may be used, and that the selected pattern may be in bas-relief or otherwise formed on the front surfaces of the various cornice sections. The selected pattern may be colored or shaded as desired, to provide a realistic and pleasing appearance for the assembled and installed, completed cornice.

The present sectioned window cornice will be seen to provide a quickly and easily installable means for decorating a window of virtually any width. The identical ends and end patterns of each of the cornice sections enable any number of the sections to be assembled together without any jarring discontinuity of the pattern at the joints between each of the sections. The clip assembly means enables the various sections to be assembled and disassembled as desired, with the hook and loop fastening material providing for the removable installation of the cornice sections to an existing drapery rod or other support, as desired. Accordingly, the present sectioned window cornice will be seen to have virtually limitless applications in numerous areas of the home and other environments.

It is to be understood that the present invention is not limited to the sole embodiment described above, but encompasses any and all embodiments within the scope of the following claims.

I claim:

1. A sectioned window cornice in use with a drapery rod adapted to be affixed to a wall, the drapery rod having a front surface, said window cornice comprising:

a plurality of symmetrical central front sections, each having a flat first end, an outwardly facing front face, an opposite rear face, and an opposite flat second end, each said flat end including at least one passage therein for mutual end to end abutting and removably assembling with one another;

a left and a right cornice front section, each having a flat first end including at least one passage therein for mutual end to end abutting and removably assembling with one of said symmetrical cornice front sections, an outwardly facing front face, an opposite rear face, and an opposite beveled second end including at least one passage therein;

a left and a right cornice side section, each having a flat first end, an outwardly facing front face, an opposite rear face, and an opposite beveled second end, each said beveled end including at least one passage therein for mutual assembly respectively of said left cornice front section and said left cornice side section together to form a right angle, and of said right cornice front section and said right cornice side section together to form a right angle;

a plurality of straight clips providing for the abutting connection of said cornice front sections together;

a plurality of right angle clips providing for the connection respectively of said left cornice front section and said left cornice side section together, and of said right cornice front section and said right cornice side section together, and;

a plurality of hook and loop material, a first component of hook and loop material being secured to each said rear face of each of said sections, a second component of hook and loop material being secured to the drapery rod providing for the removable installation of each of said sections to the drapery rod, whereby;

said central front sections and said left and right cornice front sections are removably assembled together end-to-end by means of said straight clips to form a straight front cornice panel length as desired, said left and said right cornice side section are removably assembled respectively to said left and said right front cornice section by means of said right angle clips to form a completed cornice, and said completed cornice is installed to the drapery rod using said plurality of hook and loop material.

2. The sectioned window cornice of claim 1 wherein:

each said passage of each said flat end of each of said cornice front sections terminates in an opening in said rear face of each of said sections;

each of said straight clips includes a straight central portion having opposite ends, with each of said ends terminating in a protrusion extending at an angle to said straight central portion, said protrusion being adapted to engage said opening in said passage of said flat end of each of said front sections to removably secure each of said front sections together, and;

each of said right angle clips includes a central portion having a right angle bend therein and opposite ends, with each of said ends terminating in a protrusion extending at an angle to said central portion, said protrusion being adapted to engage said opening in said passage of said beveled end of each of said left and right cornice front and side sections to removably secure each of said left and right cornice front and side sections together.

3. The sectioned window cornice of claim 1 wherein:

said second component of hook and loop material is adhesively secured to the front surface of the drapery rod.

4. The sectioned window cornice of claim 1 wherein:

said front face of each of said cornice front sections and each said cornice side section includes an identical pattern thereon.

5. The sectioned window cornice of claim 4 wherein:

said identical pattern on said each said front face of said each of said cornice front sections and each said cornice side section is further identical adjacent each said first and said second ends, thereby providing a pattern disposed across a plurality of said sections which is devoid of sharp discontinuities between each of said sections.

6. The sectioned window cornice of claim 1 wherein:

each of said cornice front sections and each said cornice side section is formed of plastic.

7. The sectioned window cornice of claim 1 wherein:

each of said cornice front sections and each said cornice side section is formed of wood.

8. The sectioned window cornice of claim 1 wherein:

each of said cornice front sections and each said cornice side section is formed of fiberboard material.

9. The sectioned window cornice of claim 1 wherein:

said straight clips and said right angle clips are each formed of a resilient material to provide for the removal thereof from each of said cornice front sections and each said left and right cornice section.

10. The sectioned window cornice of claim 9 wherein:

said straight clips and said right angle clips are each formed of plastic.

11. In combination with a drapery rod having a front face, a sectioned window cornice comprising:

a plurality of symmetrical central front sections, each having a flat first end, an outwardly facing front face, an opposite rear face, and an opposite flat second end, each said flat end including at least one passage therein for mutual end to end abutting and removably assembling with one another;

a left and a right cornice front section, each having a flat first end including at least one passage therein for mutual end to end abutting and removably assembling with one of said symmetrical cornice front sections, an outwardly facing front face, an opposite rear face, and an opposite beveled second end including at least one passage therein;

a left and a right cornice side section, each having a flat first end, an outwardly facing front face, an opposite rear face, and an opposite beveled second end, each said beveled second end including at least one passage therein for mutual assembly respectively of said left cornice front section and said left cornice side section together to form a right angle, and of said right cornice front section and said right cornice side section together to form a right angle;

a plurality of straight clips providing for the abutting connection of said cornice front sections together;

a plurality of right angle clips providing for the connection respectively of said left cornice front section and said left cornice side section together, and of said right cornice front section and said right cornice side section together, and;

a plurality of hook and loop material, a first component of hook and loop material being secured to each said rear face of each of said sections, a second component of hook and loop material being secured to said drapery rod providing for the removable installation of each of said sections to said drapery rod, whereby;

said central front sections and said left and right cornice front sections are removably assembled together end-to-end by means of said straight clips to form a straight front cornice panel length as desired, said left and said right cornice side section are removably assembled respectively to said left and said right front cornice section by means of said right angle clips to form a completed cornice, and said completed cornice is installed to said drapery rod using said plurality of hook and loop material.

12. The sectioned window cornice and drapery rod combination of claim 11 wherein:

each said passage of each said flat end of each of said cornice front sections terminates in an opening in said rear face of each of said sections;

each of said straight clips includes a straight central portion having opposite ends, with each of said ends terminating in a protrusion extending at an angle to said straight central portion, said protrusion being adapted to engage said opening in said passage of said flat end of each of said front sections to removably secure each of said front sections together, and;

each of said right angle clips includes a central portion having a right angle bend therein and opposite ends, with each of said ends terminating in a protrusion extending at an angle to said central portion, said protrusion being adapted to engage said opening in said passage of said beveled end of each of said left and right cornice front and side sections to removably secure each of said left and right cornice front and side sections together.

13. The sectioned window cornice and drapery rod combination of claim 11 wherein:

said second component of hook and loop material is adhesively secured to the front face of said drapery rod.

14. The sectioned window cornice and drapery rod combination of claim 11 wherein:

said front face of each of said cornice front sections and each said cornice side section includes an identical pattern thereon.

15. The sectioned window cornice and drapery rod combination of claim 14 wherein:

said identical pattern on said each said front face of said each of said cornice front sections and each said cornice side section is further identical adjacent each said first and said second ends, thereby providing a pattern disposed across a plurality of said sections which is devoid of sharp discontinuities between each of said sections.

16. The sectioned window cornice and drapery rod combination of claim 11 wherein:

each of said cornice front sections and each said cornice side section is formed of plastic.

17. The sectioned window cornice and drapery rod combination of claim 11 wherein:

each of said cornice front sections and each said cornice side section is formed of wood.

18. The sectioned window cornice and drapery rod combination of claim 11 wherein:

each of said cornice front sections and each said cornice side section is formed of fiberboard material.

19. The sectioned window cornice and drapery rod combination of claim 11 wherein:

said straight clips and said right angle clips are each formed of a resilient material to provide for the removal thereof from each of said cornice front sections and each said left and right cornice section.

20. The sectioned window cornice and drapery rod combination of claim 19 wherein:

said straight clips and said right angle clips are each formed of plastic.

* * * * *